United States Patent [19]

Johnson

[11] 3,954,292

[45] May 4, 1976

[54] DOOR LATCH WITH TURNABLE LOCK BUTTON

[75] Inventor: Robert W. Johnson, Rockford, Ill.

[73] Assignee: Amerock Corporation, Rockford, Ill.

[22] Filed: June 4, 1975

[21] Appl. No.: 583,771

[52] U.S. Cl. ..... 292/169.17; 292/336.3; 292/359

[51] Int. Cl.[2] ..... E05B 15/00

[58] Field of Search ..... 70/146, 147, 216; 292/169.17, 336.3, 359

[56] References Cited

UNITED STATES PATENTS 2,872,236 2/1959 Check ..... 292/336.3

*Primary Examiner*—Albert G. Craig, Jr.

*Attorney, Agent, or Firm*—Wolfe, Hubbard, Leydig, Voit & Osann, Ltd.

[57] ABSTRACT

When turned to a locked position, a turn button causes the outside operating lever of the latch to be held against rotation so as to lock the door against entry from the outside. Turning of the inside operating lever in either direction to open the door causes the turn button to return automatically to its unlocked position to prevent inadvertent locking of the door. Automatic return of the locking button is effected through the coaction of a spring-loaded pin on the inside lever with a pair of shoulders on the inner face of the turn button.

8 Claims, 13 Drawing Figures

DOOR LATCH WITH TURNABLE LOCK BUTTON

BACKGROUND OF THE INVENTION

This invention relates to a door latch of the type having inside and outside operators each adapted to effect unlatching of a reciprocable bolt when turned in either direction from a neutral position. The invention more particularly relates to a door latch in which a turn button is supported by the inside operator to rotate between locked and unlocked positions. When turned to its locked position, the button is operable to prevent rotation of the outside operator and thus prevents the door from being opened from the outside until the button is turned back to its unlocked position to cancel the locking action.

SUMMARY OF THE INVENTION

The general aim of the present invention is to provide a new and improved door latch of the above character in which the locking action of the turn button is cancelled automatically whenever the bolt is unlatched by the inside operator and regardless of which direction the inside operator is turned to effect such unlatching.

A related object is to provide a door latch in which actuation of the inside operator in either direction to unlatch the bolt is effective to turn the button from its locked position to its unlocked position.

A more detailed object is to provide a door latch in which comparatively simple and inexpensive elements on the inside operator and the button coact with one another to turn the button from its locked position to its unlocked position when the inside operator is actuated.

These and other objects and advantages of the invention will become more apparent from the following detailed description when taken in conjunction with the accompanying drawings.

DETAILED DESCRIPTION OF THE PREFERRED EMBODIMENT

Figure 1:
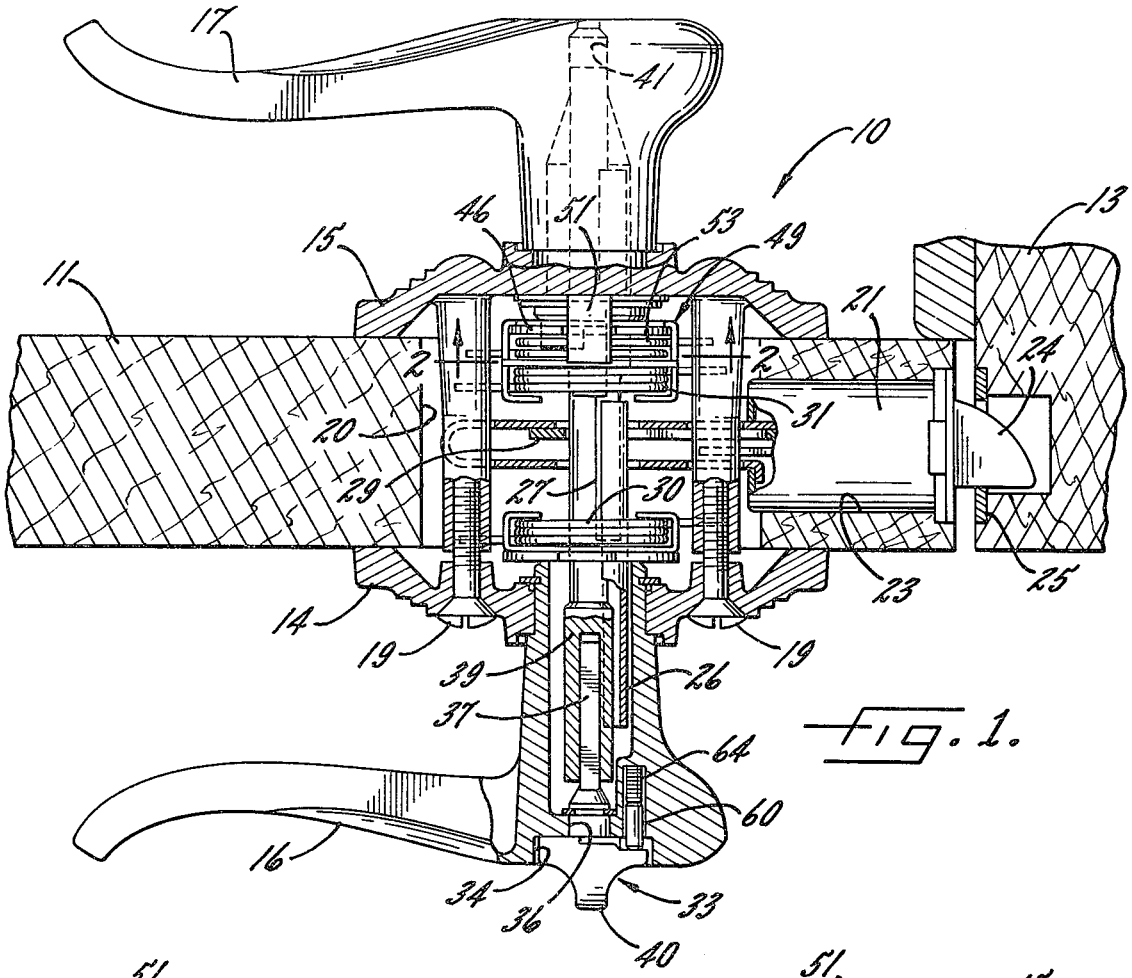
FIG. 1 is a cross-sectional view taken horizontally through a new and improved door latch incorporating the novel features of the present invention and shows the latch installed in a typical door.

As shown in the drawings for purposes of illustration, the invention is embodied in a privacy latch 10 for selectively holding a door 11 such as a bedroom or bathroom door in a closed position relative to a jamb 13. Herein, the latch includes inside and outside escutcheons 14 and 15 rotatably supporting inside and outside operators or levers 16 and 17, respectively, and secured to one another and the door 11 by screws 19 which extend into an opening 20 formed through the door.

A housing 21 is secured within a second opening 23 in the door 11 and slidably supports a reciprocable bolt 24 which normally latches within a strike 25 on the jamb 13. The bolt is adapted to be retracted from the strike whenever either of the levers 16 or 17 is turned in either direction from a substantially horizontal neutral position (FIG. 6) to a first unlatching position (FIG. 9*a*) or a second unlatching position (FIG. 10*a*). For this purpose, nested half-round spindles 26 and 27 (FIG. 1) are connected to rotate with the levers 16 and 17, respectively, and project into an opening in a retractor 29 which is attached to the bolt. Whenever either lever is turned either clockwise or counterclockwise from its neutral position, its associated spindle engages an edge of the opening in the retractor and effects unlatching of the bolt. A torsion spring 30 is associated with the inside spindle 26 and automatically returns the inside lever 16 to its neutral position when the lever is manually released after being turned in either direction. Automatic return of the outside lever 17 is effected by a similar torsion spring 31 which is associated with the outside spindle 27.

Figure 4:
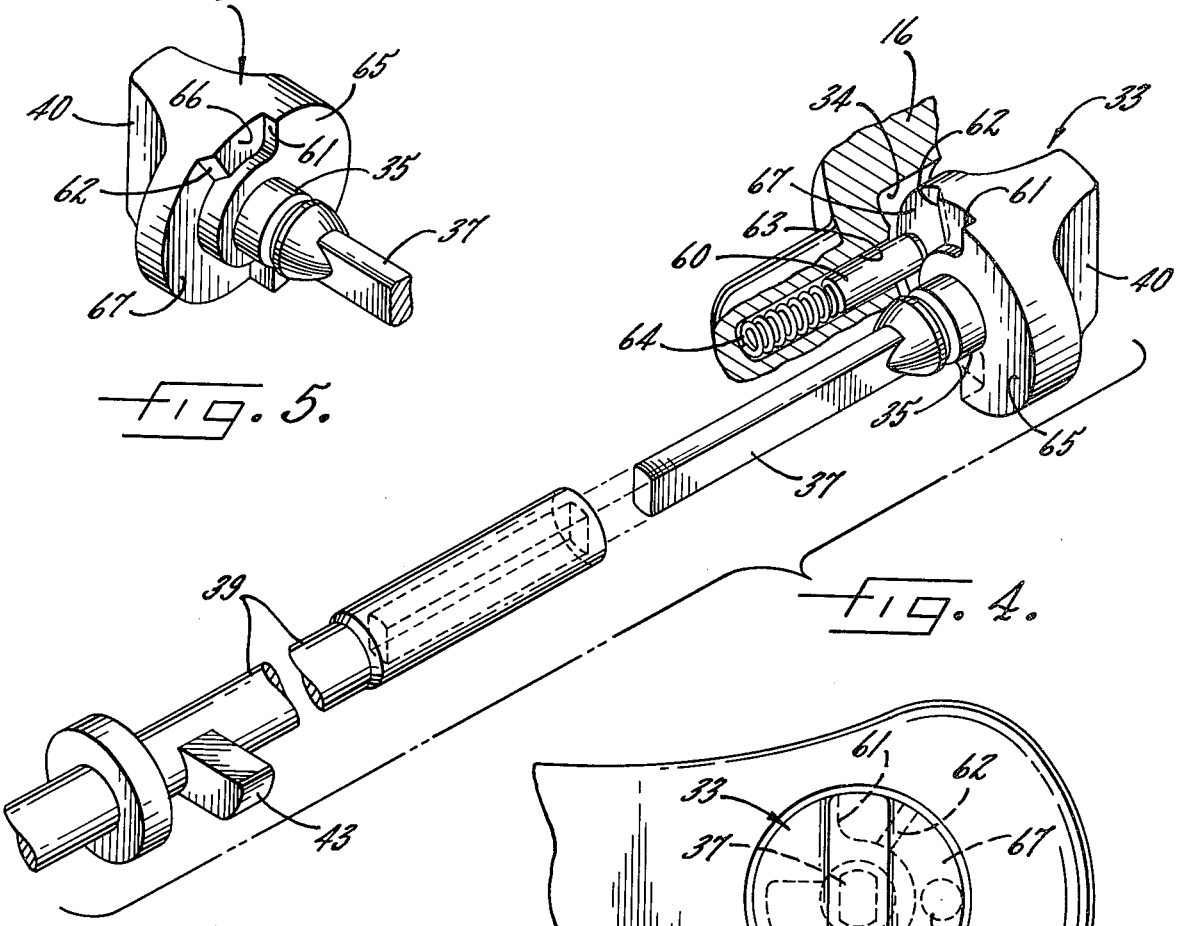
FIG. 4 is an exploded perspective view showing the turn button and certain other parts of the latch.

In order to lock the door 11 against entry from the outside, a turn button 33 is located within a counterbore 34 in the inside lever 16 and includes a shank 35 (FIG. 4) which is rotatably journaled in a bore 36 (FIG. 1) in the inside lever. A square shaft 37 (FIG. 4) is formed integrally with the shank and is non-rotatably telescoped into a locking spindle 39 which extends through the opening 20 in the door and is rotatably supported within the outside lever 17. By gripping a rib 40 on the button and turning the rib clockwise from a vertical position (FIG. 6) to a horizontal position (FIG. 7), the locking button may be turned from an unlocked position to a locked position. The button also may be turned between its locked and unlocked positions by inserting a key or tool into a hole 41 (FIG. 1) in the outside lever and turning the locking spindle 39.

As the button 33 is turned, manually from its unlocked position toward its locked position, an ear 43 (FIG. 2) on the locking spindle 39 cams against a curved edge 44 of an opening 45 in a locking slide 46 guided for up and down movement by the sides 47 of a housing 49, the latter being rotatable with the outside spindle 27. Such camming shifts the slide upwardly to the position shown in FIG. 3 and causes the edges of a notch 50 in the slide to embrace a lug 51 projecting inwardly from the outside escutcheon 15. The lug thus prevents rotation of the slide 46, the housing 49 and the outside spindle 27 so that the outside lever 17 cannot be turned to unlatch the bolt 24.

Figure 2:
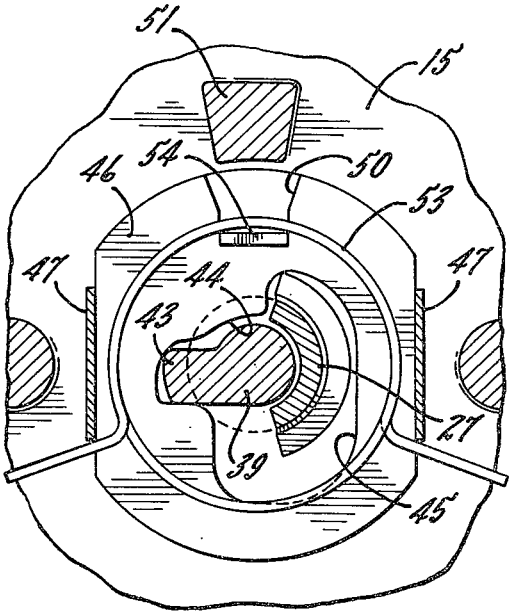
FIG. 2 is an enlarged fragmentary cross-section taken substantially along the line 2—2 of FIG. 1.
Figure 3:
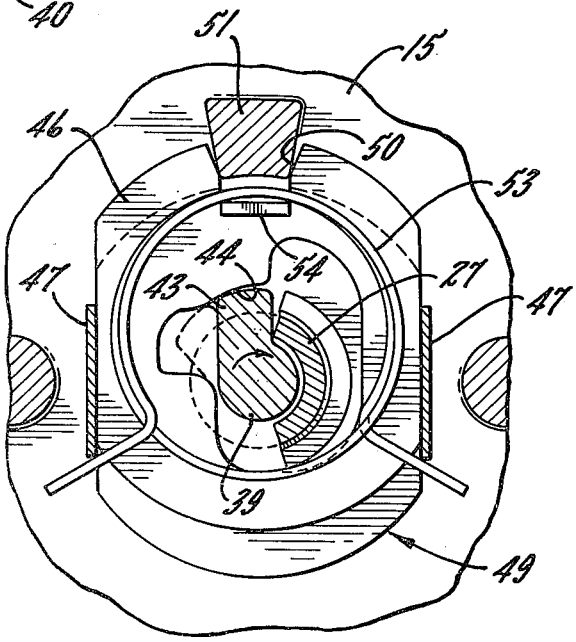
FIG. 3 is a view similar to FIG. 2 but shows certain parts of the latch in moved positions.

As shown in FIG. 2, a torsion spring 53 is loaded between a tab 54 on the slide 46 and the lower edges of the sides 47 of the housing 49. When the button 33 is turned back toward its unlocked position, the torsion spring 53 urges the slide 46 downwardly to retract the notch 50 away from the lug 51 and thus free the outside lever 17 for rotation. After the button has been turned approximately 35 degrees toward its unlocked position to the position shown in phantom in FIG. 3, the torsion spring 53 automatically turns the button through the remaining distance by virtue of the curved edge 44 of the opening 45 in the slide 46 camming against the ear 43 on the locking spindle 39. Accordingly, it is necessary only to start the button turning counterclockwise toward its unlocked position and then the spring 53 will snap the button around to that position.

The present invention contemplates constructing the door latch 10 in such a manner that regardless of which direction the inside lever 16 is turned to unlatch the bolt 24, the turn button 33—if locked—will always be automatically rotated to its unlocked position so as to cancel the locking action and prevent inadvertent locking of the door 11 by a person leaving the room. Thus, the invention provides a latch with a turnable locking button 33 which is rotated out of its locked position irrespective of the direction which a person chooses to turn the inside lever 16 to open the door.

Figure 5:
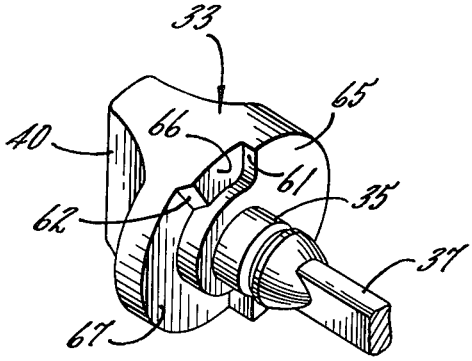
FIG. 5 is a perspective view of the turn button.
Figure 8:
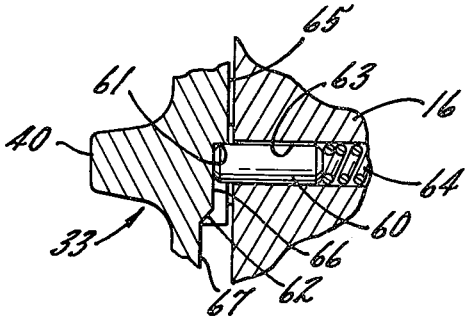
FIG. 8 is a fragmentary cross-section taken substantially along the line 8—8 of FIG. 7.

More specifically, the foregoing is achieved through the provision of coacting elements 60, 61 and 62 on the inside lever 16 and the turn button 33. In this instance, the element 60 is in the form of a plunger or pin (FIGS. 1, 4 and 8) which is slidably mounted in a hole 63 in the bottom of the counterbore 34 in the inside lever 16, there being a coil spring 64 telescoped into the hole and urging the pin 60 outwardly into engagement with the inner face of the button 33. The elements 61 and 62 are defined by circumferentially facing and angularly and axially spaced shoulders on the inner face of the button (see FIGS. 4 and 5). The inner face of the button is formed by three surfaces 65, 66 and 67 (FIG. 5) disposed in three axially spaced planes, and the shoulder 61 defines the junction between the surfaces 65 and 66 while the shoulder 62 is spaced angularly about 35° from the shoulder 61 and defines the junction between the surfaces 66 and 67. As shown most clearly in FIGS. 4 and 5, the shoulder 61 is disposed perpendicular to the surfaces 65 and 66 but the shoulder 62 slopes radially inwardly upon progressing from the surface 67 toward the surface 66.'

Figure 6:
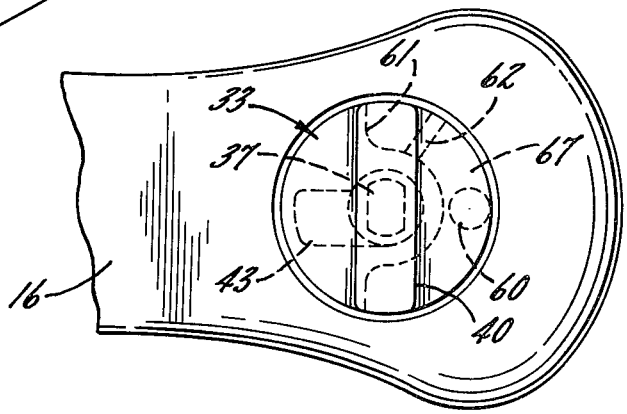
FIG. 6 is a fragmentary elevational view of the inside operator and the turn button and shows the latter in its unlocked position.

With the foregoing arrangement, the end of the springbiased pin 60 bears against the button surface 67 when the turn button 33 is in its unlocked position shown in FIG. 6. As the button is turned clockwise toward its locked position (FIG. 7), the pin is cammed inwardly by the sloped shoulder 62 and then presses against the button surface 66. When the button reaches its locked position, the shoulder 61 engages the end portion of the pin and prevents further clockwise turning of the pin (see FIGS. 7 and 8).

Figure 7:
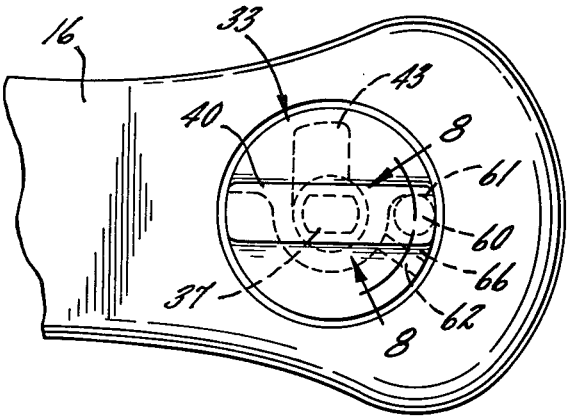
FIG. 7 is a view similar to FIG. 6 but shows the turn button in its locked position.
Figure 9A:
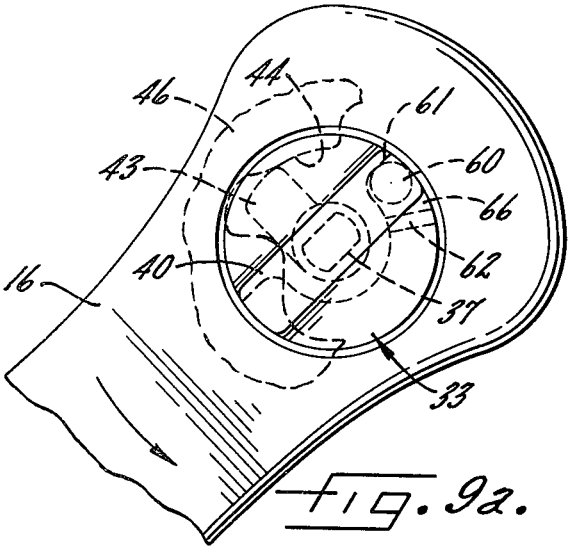
FIGS. 9*a* and 9*b* are views similar to FIG. 7 but show the sequential steps of effecting turning of the button to its unlocked position when the inside operator is turned counterclockwise to unlatch the bolt.
Figure 9B:
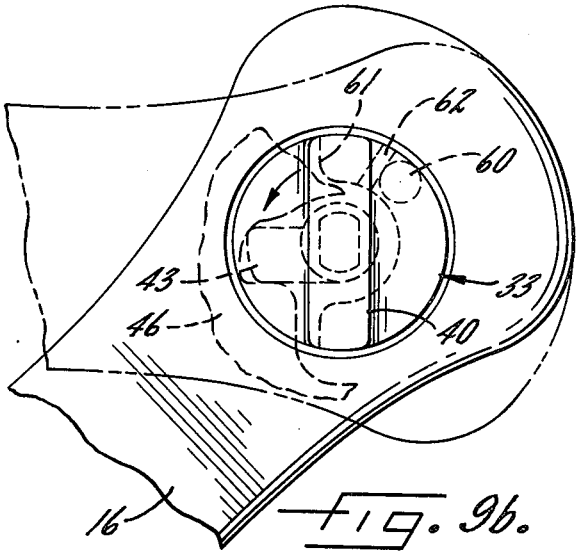
Figure 10A:
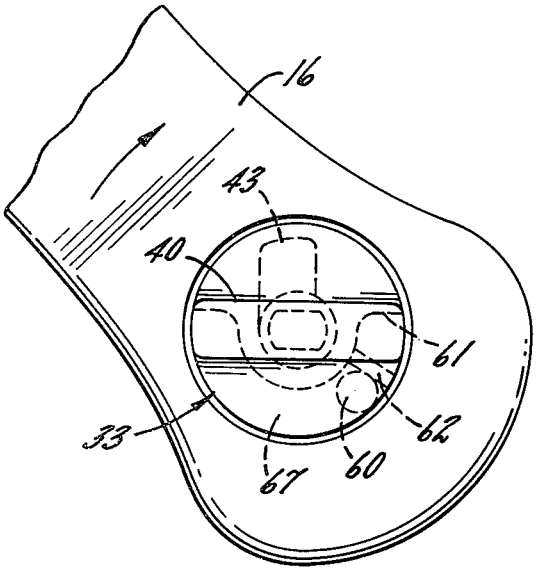
FIGS. 10*a* and 10*b* are views similar to FIG. 7 but show the sequential steps of effecting turning of the button to its unlocked position when the inside operator is turned clockwise to unlatch the bolt.

If the door 11 then is opened by turning the inside lever 16 counterclockwise from its neutral position shown in FIG. 7 toward its unlatching position shown in FIG. 9*a*, the pin 60 turns with the lever and bears against the shoulder 61 to turn the button in a counterclockwise direction. As soon as the button has been turned counterclockwise through approximately 35° by the pin 60, the slide 46 cams against the ear 43 on the locking spindle 39 to snap the button into its unlocked position (see FIG. 9b). Accordingly, the button is turned 90° from its locked position to its unlocked position even though the inside lever 16 may have been turned through a considerably smaller angle to unlatch the bolt 24.

Figure 10B:
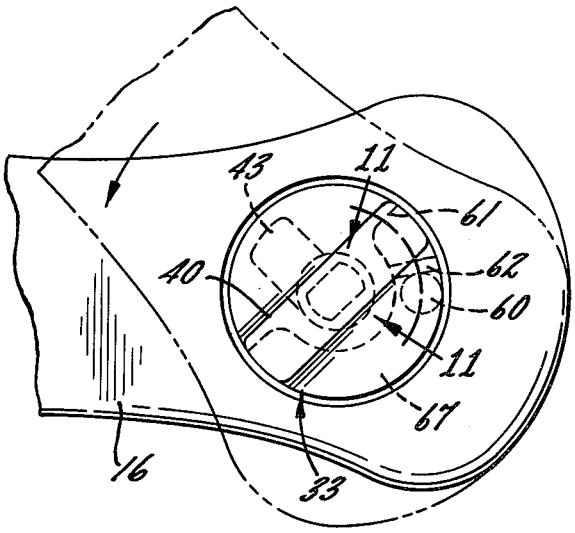
Figure 11:
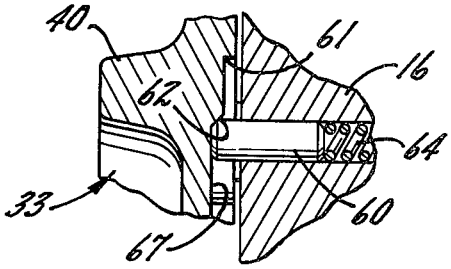
FIG. 11 is a fragmentary cross-section taken substantially along the line 11—11 of FIG. 10*b*.

If the button 33 is in its locking position and the bolt 24 is retracted by clockwise turning of the inside lever 16 to the unlatching position shown in FIG. 10*a*, the pin 60 simply turns clockwise away from the shoulder 61 without turning the button 33, rides past the sloped shoulder 62 and then snaps into pressing engagement with the button surface 67 after the inside lever has been turned clockwise through an angle of about 35°. Further clockwise turning of the inside lever simply moves the pin further away from the shoulder 62. But, when the inside lever is released and is returned automatically in a counterclockwise direction by the spring 30, the end portion of the pin 60 engages the shoulder 62 and drives the button 33 counterclockwise towards its unlocked position (see FIGS. 10*b* and 11). After the button has been driven through about 35° by the pin 60, the slide 46 acts against the ear 43 and snaps the button through the remaining distance to its unlocked position. The button thus is moved to its unlocked position on the return stroke of the lever 16 rather than on its unlatching stroke as is the case when the bolt 24 is retracted by counterclockwise turning of the lever.

From the foregoing, it will be apparent that the presnt invention brings to the art a new and improved door latch 10 with a turnable locking button 33 which is automatically returned to its unlocked position regardless of which direction the inside lever 16 is turned to open the door 11. Also, the action of slide 46 enables the button to return through 90° without need of positively driving the button through that distance with the inside lever. The pin 60, the spring 64 and the shoulders 61 and 62 can be incorporated into the latch at very little expense and thus the automatic cancelling feature does not significantly increase the cost of the latch.

I claim:

1. A door latch having a reciprocable latching bolt and having rotatable inside and outside operators each capable of effecting unlatching of said bolt when rotated in one direction from a neutral position to a first unlatching position and when rotated in the opposite direction from said neutral position to a second unlatching position, a turn button supported by said inside operator to rotate between locked and unlocked positions, means associated with said button and operable to prevent rotation of said outside operator when said button is in said locked position and to free said outside operator for rotation when said button is in said unlocked position, a pair of circumferentially facing and angularly and axially spaced shoulders on the inner face of said button, a plunger carried on said inside operator and biased outwardly toward the inner face of said button, said plunger engaging one of said shoulders and causing said button to turn automatically toward said unlocked position when said button is in said locked position and said inside operator is turned from said neutral position to said first unlatching position, and said plunger engaging the other of said shoulders and causing said button to turn automatically toward said unlocked position when said button is in said locked position and said inside operator is turned from said second unlatching position to said neutral position.

2. A door latch as defined in claim 1 in which the inner face of said button is defined by first, second and third surfaces disposed in three axially spaced planes, said one shoulder defining the junction between said first and second surfaces, and said other shoulder defining the junction between said second and third surfaces.

3. A door latch having a reciprocable latching bolt and having rotatable inside and outside operators each capable of effecting unlatching of said bolt when rotated in a first direction from a neutral position to a first unlatching position and when rotated in the opposite direction from said neutral position to a second unlatching position, a turn button supported by said inside operator to rotate between locked and unlocked positions, means associated with said button and operable to prevent rotation of said outside operator when said button is in said locked position and to free said outside operator for rotation when said button is in said unlocked position, and coacting means on said inside operator and said button for causing said button to turn automatically toward said unlocked position when said button is in said locked position and said inside operator is rotated between said neutral position and either one of said unlatching positions.

4. A door latch as defined in claim 3 further including means for automatically returning said inside operator from said unlatching positions to said normal position, said coacting means including (a) a first element on one of said inside operator and said turn button and (b) second and third elements on the other of said inside operator and said turn button, said first element engaging said second element and turning said button toward said unlocked position as said inside operator is turned from said neutral position to said first unlatching position, and said first element engaging said third element and turning said button toward said unlocked position as said inside operator returns from said second unlatching position to said neutral position.

5. A door latch as defined in claim 4 in which said first element is on said inside operator and in which said second and third elements are on said turn button.

6. A door latch as defined in claim 5 in which said second and third elements comprise axially and angularly spaced and circumferentially facing shoulders on the inner side of said button, said first element comprising a plunger carried by inside operator and urged outwardly toward the inner side of said button.

7. A door latch as defined in claim 6 in which the shoulder which forms said third element slopes radially upon progressing axially and defines a surface which cams said plunger inwardly as said button is turned from said unlocked position toward said locked position.

8. A door latch as defined in claim 3 further including means for urging said button into said unlocked position after said button has been turned from said locked position toward said unlocked position.

* * * * *